US005178325A

United States Patent [19]

Nielsen

[11] Patent Number: 5,178,325

[45] Date of Patent: Jan. 12, 1993

[54] APPARATUS AND METHODS FOR APPLICATION OF COATINGS WITH COMPRESSIBLE FLUIDS AS DILUENT BY SPRAYING FROM AN ORIFICE

[75] Inventor: Kenneth A. Nielsen, Charleston, W. Va.

[73] Assignee: Union Carbide Chemicals & Plastics Technology Corporation, Danbury, Conn.

[21] Appl. No.: 720,623

[22] Filed: Jun. 25, 1991

[51] Int. Cl.[5] ..... B05B 1/00

[52] U.S. Cl. ..... 239/1; 239/589

[58] Field of Search ..... 239/1, 8, 589, 590, 239/601

[56] References Cited

U.S. PATENT DOCUMENTS

| | | | |
|---|---|---|---|
| 3,754,710 | 8/1973 | Chimura | 239/601 |
| 4,097,000 | 6/1978 | Derr | 239/601 |
| 4,124,528 | 11/1978 | Modell | 252/411 R |
| 4,189,914 | 2/1980 | Marek et al. | 60/726 |
| 4,258,885 | 3/1981 | Legeza | 239/601 |
| 4,346,849 | 8/1982 | Rood | 239/601 |
| 4,375,387 | 3/1983 | deFilippi et al. | 202/169 |
| 4,582,731 | 4/1986 | Smith | 427/421 |
| 4,618,101 | 10/1986 | Piggott | 239/589 |
| 4,619,735 | 10/1986 | Norton | 162/135 |
| 4,734,227 | 3/1988 | Smith | 264/13 |
| 4,734,451 | 3/1988 | Smith | 524/493 |
| 4,737,384 | 4/1988 | Murthy et al. | 427/369 |
| 4,923,720 | 5/1990 | Lee et al. | 427/422 |

FOREIGN PATENT DOCUMENTS

| | | | |
|---|---|---|---|
| 2603664 | 8/1977 | Fed. Rep. of Germany . | |
| 2853066 | 6/1980 | Fed. Rep. of Germany . | |
| 294634 | 3/1932 | Italy | 239/589 |
| 55-84328 | 6/1980 | Japan . | |
| 58-168674 | 10/1983 | Japan . | |
| 59-16703 | 1/1984 | Japan . | |
| 62-152505 | 7/1987 | Japan . | |
| 868051 | 4/1988 | South Africa . | |

OTHER PUBLICATIONS

Francis, A. W., "Ternary Systems of Liquid Carbon Dioxide," J. Phys. Chem. 58:1099, Dec. 1954.

Smith, R. D., et al., "Direct Fluid Injection Interface for Capillary Supercritical Fluid Chromatography-Mass Spectrometry" J. Chromatog. 247 (1982):231-243.

Krukonis, V., "Supercritical Fluid Nucleation of Difficult-to-Comminute Solids", paper presented at 1984 Annual Meeting, AIChE, San Francisco, Calif., Nov. 25-30, 1984.

Dandge, D. K. et al., "Structure Solubility Correlations: Organic Compounds and Dense Carbon Dioxide Binary Systems", Ind. Eng. Chem. Prod. Res. Dev. 24:162-166 (1985).

Matson, D. W., et al., "Production of Powders and Films by the Rapid Expansion of Supercritical Solutions", J. Materials Science 22:1919-1928 (1987).

McHugh, M. A. et al., "Supercritical Fluid Extraction, Principles and Practice", Butterworth Publishers (1986) Contents and Appenddices.

Cobbs, W. et al., "High Solids Coatings Above 80% by Volume", Water-Borne & High Solids Coatings Symposium, Mar. 1980.

Matson, D. W. et al., "Production of Fine Powders by the Rapid Expansion of Supercritical Fluid Solutions", Advances in Ceramics, vol. 21, pp. 109-123 (1987).

Kitamure, Y., et al., "Critical Superheat for Flashing of Superheated Liquid Jets", Ind. Eng. Chem. Fundam. 25:206-211, (1986).

Peterson, R. C. et al., "The Formation of Polymer Fibers From the Rapid Expansion of SCF Solutions" Pol. Eng. & Sci. (1987) v. 27, pp. 1693-1697.

*Primary Examiner*—Andres Kashnikow
*Assistant Examiner*—Karen B. Merritt
*Attorney, Agent, or Firm*—M. N. Reinisch

[57] ABSTRACT

This invention is directed to an improved spray apparatus and corresponding methods for coating substrates with a coating material and a supercritical fluid or a subcritical compressed fluid, which apparatus is provided with an airless spray nozzle that produces a spray with reduced average velocity thereby minimizing the undesirable excessive momentum of the spray as well as the sideways deflection of the spray that occurs as it impacts of substrate. The spray nozzle is comprised of an elongated orifice passageway having a length sufficiently long in relation to the equivalent diameter so as to reduce the average spray velocity of the coating material.

33 Claims, 5 Drawing Sheets

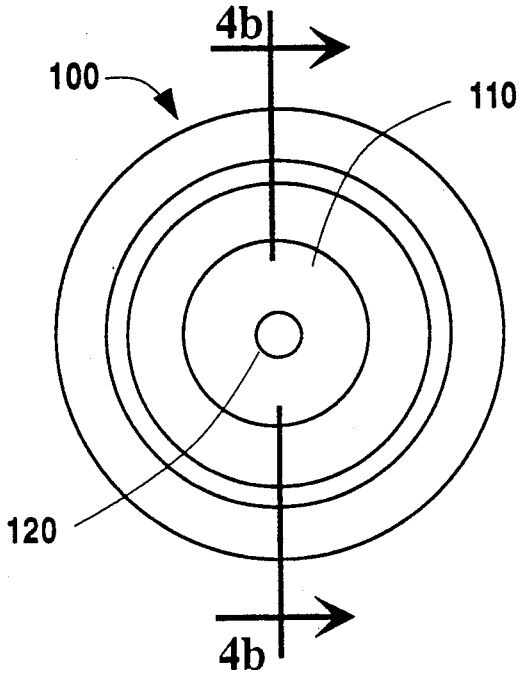
Fig. 4a
Fig. 4b
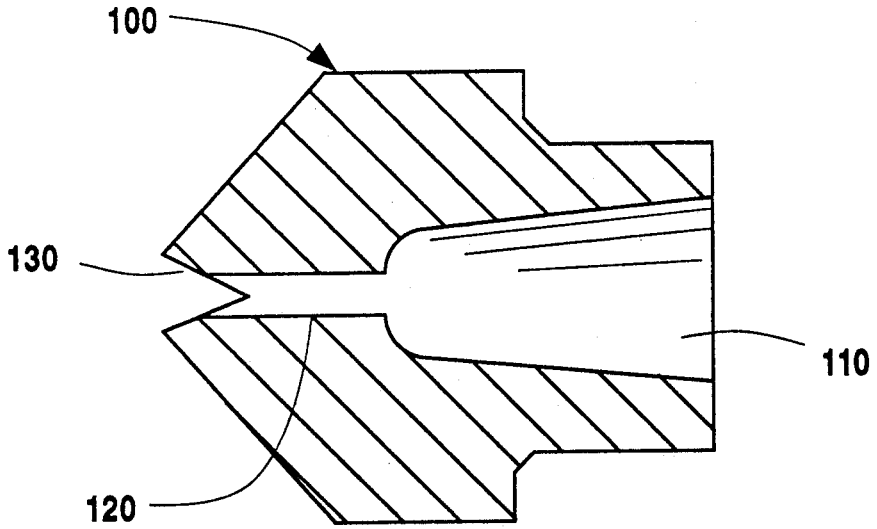

APPARATUS AND METHODS FOR APPLICATION OF COATINGS WITH COMPRESSIBLE FLUIDS AS DILUENT BY SPRAYING FROM AN ORIFICE

The spray nozzle is comprised of an elongated orifice passageway having a length sufficiently long in relation to the equivalent diameter so as to reduce the average spray velocity of the coating material.

RELATED PATENT APPLICATIONS

This application is related to application Ser. No. 418,820, filed Oct. 4, 1989, now U.S. Pat. No. 4,923,720, issued May 8, 1990. This application also contains subject matter related to application Ser. No. 327,273, filed Mar. 22, 1989, and application Ser. No. 327,275, filed Mar. 22, 1989, now U.S. Pat. No. 5,009,367, issued Apr. 23, 1991, the contents of which are all incorporated herein by reference as if set out in full.

FIELD OF THE INVENTION

Generally, this invention relates to spraying methods and apparatus for coating substrates wherein the coating mixture that is sprayed contains a non-compressible fluid and a compressible fluid, particularly a coating material and a supercritical fluid or a subcritical compressed fluid that is used as a viscosity reducing diluent. More particularly, this invention is directed to an improved spray apparatus for coating substrates with a coating material and a supercritical fluid or a subcritical compressed fluid, which apparatus is provided with an airless spray nozzle that produces a spray with reduced average velocity thereby minimizing the undesirable excessive momentum of the spray as well as the sideways deflection of the spray that occurs as it impacts a substrate. Such an apparatus helps promote efficient deposition of the coating material onto the substrate.

BACKGROUND OF THE INVENTION

Prior to the inventions described in the aforementioned related patent applications, the liquid spray application of coatings, such as paints, lacquers, enamels, and varnishes, was effected solely through the use of organic solvents as viscosity reduction diluents. However, because of increased environmental concern, efforts have been directed to reducing the pollution resulting from painting and finishing operations. For this reason, there has been a great deal of emphasis placed on the development of new coatings technologies which diminish the emission of organic solvent vapors. A number of technologies have emerged as having met most but not all of the performance and application requirements, and at the same time meeting emission requirements and regulations. They are: (a) powder coatings, (b) water-borne dispersions, (c) waterborne solutions, (d) non-aqueous dispersions, and (e) high solids coatings. Each of these technologies has been employed in certain applications and each has found a niche in a particular industry. However, at the present time, none has provided the performance and application properties that were initially expected.

Powder coatings, for example, while providing ultra low emission of organic vapors, are characterized by poor gloss or good gloss with heavy orange peel, poor distinctness of image gloss (DOI), and poor film uniformity. Moreover, to obtain even these limited performance properties generally requires excessive film thickness and/or high curing temperatures. Pigmentation of powder coatings is often difficult, requiring at times milling and extrusion of the polymer-pigment composite mixture followed by cryogenic grinding. In addition, changing colors of the coating often requires its complete cleaning, because of dust contamination of the application equipment and finishing area.

Water-borne coatings are very difficult to apply under conditions of high relative humidity without serious coating defects. These defects result from the fact that under conditions of high humidity, water evaporates more slowly than the organic cosolvents of the coalescing aid, and as might be expected in the case of aqueous dispersions, the loss of the organic cosolvent-/coalescing aid interferes with film formation. Poor gloss, poor uniformity, and pin holes unfortunately often result. Additionally, water-borne coatings are not as resistant to corrosive environments as are more conventional solvent borne coatings.

Coatings applied with organic solvents at high solids levels avoid many of the pitfalls of powder and water-borne coatings. However, in these systems the molecular weight of the polymer has been decreased and reactive functionality has been incorporated therein so that further polymerization and crosslinking can take place after the coating has been applied. It has been hoped that this type of coating will meet the ever-increasing regulatory requirements and yet meet the most exacting coatings performance demands. However, there is a limit as to the ability of this technology to meet the performance requirement of a commercial coating operation. Present high solids systems have difficulty in application to vertical surfaces without running and sagging of the coating. If they possess good reactivity, they often have poor shelf and pot life. However, if they have adequate shelf stability, they cure and/or crosslink slowly or require high temperature to effect an adequate coating on the substrate.

Clearly, what was needed was an environmentally safe, non-polluting diluent that can be used to thin very highly viscous polymer and coatings compositions to liquid spray application consistency. Such a diluent would allow utilization of the best aspects of organic solvent borne coatings applications and performance while reducing the environmental concerns to an acceptable level. Such a coating system could meet the requirements of shop-applied and field-applied liquid spray coatings as well as factory-applied finishes and still be in compliance with environmental regulations.

Such a needed diluent was indeed found and is discussed in the aforementioned related applications which teach, among other things, the utilization of supercritical fluids or subcritical compressed fluids, such as carbon dioxide or nitrous oxide, as diluents in highly viscous organic solvent borne and/or highly viscous non-aqueous dispersions coatings compositions to dilute these compositions to application viscosity required for liquid spray techniques.

As used herein, it will be understood that a "supercritical fluid" is a material which is at a temperature and pressure such that it is above, at, or slightly below its "critical point" As used herein, the "critical point" is the transition point at which the liquid and gaseous states of a substance merge into each other and represents the combination of the critical temperature and critical pressure for a given substance. The "critical temperature", as used herein, is defined as the temperature above which a gas cannot be liquefied by an increase in pressure. The "critical pressure", as used herein, is defined as that pressure which is just sufficient to cause the appearance of two phases at the critical temperature. As used herein, a "compressed fluid" is a fluid which may be in its gaseous state, its liquid state, or a combination thereof depending upon the particular temperature and pressure to which it is subjected upon admixture with the composition which is to have its viscosity reduced and the vapor pressure of the fluid at that particular temperature, but which is in its gaseous state at standard conditions of 0° C. and one atmosphere (STP). The compressed fluid may comprise a supercritical or subcritical fluid.

Also as used herein, the phrases "coating composition", "coating material", and "coating formulation" are understood to mean conventional coating compositions, materials, and formulations that have no supercritical fluid or subcritical compressed fluid admixed therewith. Also as used herein, the phrases "liquid mixture", "spray mixture", "coating mixture", and "admixed coating composition" are meant to include an admixture of a coating material, coating composition, or coating formulation with at least one supercritical fluid or at least one subcritical compressed fluid.

It is understood, of course, that the terms "coating composition", "coating material", and "coating formulation" are not limited to coatings that are only used to protect and/or enhance the appearance of a substrate, such as paints, lacquers, enamels, and varnishes. Indeed, the coating composition may provide a coating that acts as an adhesive or that is a release agent; a lubricant; a cleaning agent; or the like. Such coating compositions may also include those that are typically utilized in the agricultural field in which fertilizers, weed killing agents, and the like, are dispensed. Such coating compositions may also include those that are used to coat agricultural products such as fruits and vegetables or to coat pharmaceutical or medicinal products such as pills and tablets. The specific nature of the coating composition is not critical to the present invention provided that it can be admixed with the subcritical compressed fluid and then be sprayed.

Aforementioned U.S. Pat. No. 4,923,720 discloses processes and apparatus for the liquid spray application of coatings to a substrate that minimize the use of environmentally undesirable organic diluents. One of the process embodiments of that patent includes:

(1) forming a liquid mixture in a closed system, said liquid mixture comprising:

(a) at least one polymeric compound capable of forming a coating on a substrate;

(b) at least one supercritical fluid, in at least an amount which when added to (a) is sufficient to render the viscosity of said mixture to a point suitable for spray application; and (2) spraying said liquid mixture onto a substrate to form a liquid coating thereon.

That patent is also directed to a liquid spray process in which at least one active organic solvent (c) is admixed with (a) and (b) above prior to the liquid spray application of the resulting mixture to a substrate. The preferred supercritical fluid disclosed is supercritical carbon dioxide. The process employs an apparatus in which the mixture of the components of the liquid spray mixture can be blended and sprayed onto an appropriate substrate. The apparatus includes:

(1) means for supplying at least one polymeric compound;

(2) means for supplying at least one active solvent;

(3) means for supplying supercritical carbon dioxide fluid;

(4) means for forming a liquid mixture of components supplied from (1)-(3); and (5) means for spraying said liquid mixture onto a substrate.

The apparatus may also provide for (6) means for heating any of said components and/or said liquid mixture of components.

U.S. patent application Ser. No. 631,680, filed Dec. 21, 1990, discloses processes for reducing the viscosity of compositions containing one or more polymeric compounds so as to make them transportable by adding a subcritical compressed fluid, which fluid is a gas at standard conditions of 0° C. and one atmosphere pressure. Among these is a process for the liquid spray application of coatings to a substrate that minimizes the use of environmentally undesirable organic diluents and simultaneously reduces the pressure and/or temperature needed to achieve such a viscosity reducing diluent effect. One of the embodiments of that patent application includes a process for the liquid spray application of coatings to a substrate, which comprises:

(1) forming a liquid mixture in a closed system, said liquid mixture comprising:

(a) at least one or more liquid polymeric compounds capable of forming a coating on a substrate wherein the number average molecular weight of the one or more liquid polymeric compounds is less than about 5,000 and (b) at least one subcritical compressed fluid in at least an amount which when added to (a) is sufficient to render the viscosity of said mixture to a point suitable for spray application, wherein the subcritical compressed fluid is a gas at standard conditions of 0° C. and one atmosphere (STP); and (2) spraying said liquid mixture onto a substrate to form a liquid coating thereon having substantially the composition of the said coating formulation.

That patent application is also directed to a liquid spray application process in which at least one active solvent is added in which one or more of the polymeric compounds are at least partially soluble and which is at least partially miscible with the subcritical compressed fluid. In a preferred embodiment, the subcritical compressed fluid is carbon dioxide. Liquid polymeric compounds are not required in this alternative embodiment. In yet another embodiment, the coating compositions may also contain one or more polymeric compounds having higher number-average molecular weights provided that at least 75 weight percent of the total weight of all polymeric compounds has a weight-average molecular weight of less than about 20,000.

Smith, in U.S. Pat. No. 4,582,731, issued Apr. 15, 1986, U.S. Pat. No. 4,734,227, issued Mar. 29, 1988, and U.S. Pat. No. 4,734,451, issued Mar. 29, 1988, discloses methods and apparatus for the deposition of thin films and the formation of powder coatings through the molecular spray of solutes dissolved in supercritical fluid solvents, which may contain organic solvents. The concentration of said solutes are described as being quite dilute; on the order of 0.1 percent. In conventional coating applications, the solute concentration is normally 50 times or more greater than this level.

The molecular sprays disclosed in the Smith patents are defined as a spray "of individual molecules (atoms) or very small cluster of solute" which are in the order of about 30 Angstroms in diameter. These "droplets" are more than $10^6$ to $10^9$ less massive than the droplets formed in conventional application methods that Smith refers to as "liquid spray" applications.

Sievers, et al., in U.S. Pat. No. 4,970,093, issued Nov. 13, 1990, disclose a method for depositing a film of a desired material on a substrate, which comprises dissolving at least one reagent in a supercritical fluid comprising at least one solvent. Either the reagent is capable of reacting with or is a precursor of a compound capable of reacting with the solvent to form the desired product, or at least one additional reagent is included in the supercritical solution and is capable of reacting with or is a precursor of a compound capable of reacting with the first reagent or with a compound derived from the first reagent to form the desired material. The supercritical solution is rapidly expanded to produce a vapor or aerosol and a chemical reaction is induced in the vapor or aerosol so that a film of the desired material resulting from the chemical reaction is deposited on the substrate surface.

The process disclosed in the Sievers, et al. patent utilizes dilute solutions of reagent(s) in the form of a supercritical solution to apply thin solid films by reaction of the vapor or aerosol that results from rapid expansion of the supercritical solution. The patent teaches that selection of a suitable supercritical solvent is an important feature, because the supercritical solvent must expand rapidly with minimal droplet and molecular cluster formation, in order to allow formation of a homogeneous, nongranular film by reaction. After rapid expansion, the solution is substantially vaporized creating individual molecules or small clusters of the reagents and solvent, which can rapidly participate in chemical reactions at or near the substrate surface to form the desired film. That is, a molecular spray such as taught by Smith is desired and a liquid spray is avoided.

Coating compositions are commonly applied to a substrate by passing them under pressure through an orifice into air in order to form a liquid spray, which impacts the substrate and forms a liquid coating. In the coatings industry, three types of orifice sprays are commonly used; namely, air spray, airless spray, and air-assisted airless spray.

Air spray uses compressed air to break up the coating composition into droplets and to propel the droplets to the substrate. The most common type of air nozzle mixes the coating composition and high-velocity air outside of the nozzle to cause atomization. Auxiliary air streams modify the shape of the spray. The coating composition flows through the orifice in the spray nozzle at a low pressure, typically less than 18 psi. Air spray is used to apply high quality coatings because it produces fine droplet size and a "feathered" spray, that is, the spray has a uniform interior and tapered edges. This is particularly desirable so that adjacent layers of sprayed coating can be overlapped to form a coating with uniform thickness. However, because of the high air volume, air spray deposits the coating inefficiently onto the substrate, that is, it has low transfer efficiency, which wastes coating. Furthermore, air spray uses a large concentration of organic solvents to produce the low viscosity needed for atomization, which causes air pollution.

Airless spray uses a high pressure drop across the spray orifice to propel the coating composition through the orifice at high velocity. Upon exiting the orifice, the high-velocity liquid breaks up into droplets and disperses into the air to form a liquid spray. The momentum of the spray carries the droplets to the substrate. Spray pressures typically range from 700 to 5,000 psi. The spray tip is contoured to modify the shape of the liquid spray, which is usually a round or elliptical cone or a flat fan.

The conventional atomization mechanism of airless sprays is well known and is discussed and illustrated by Dombroski, N. and Johns, W. R., *Chemical Engineering Science* 18: 203, 1963. The coating exits the orifice as a liquid film that becomes unstable from shear induced by its high velocity relative to the surrounding air. Waves grow in the liquid film, become unstable, and break up into liquid filaments that likewise become unstable and break up into droplets. Atomization occurs because cohesion and surface tension forces, which hold the liquid together, are overcome by shear and fluid inertia forces, which break it apart. This process is shown photographically for an actual paint in the brochure entitled "Cross-Cut TM" "Airless Spray Gun Nozzles", Nordson Corporation, Amherst, Ohio. As used herein, "liquid-film atomization" and "liquid-film spray" refer to a spray, spray fan, or spray pattern in which atomization occurs by this conventional mechanism.

In liquid-film atomization, however, the cohesion and surface tension forces are not entirely overcome and they profoundly affect the spray, particularly for viscous coating compositions. Conventional airless spray techniques are known to produce coarse droplets and defective spray fans that limit their usefulness to applying low-quality coating films. Higher viscosity increases the viscous losses that occur within the spray orifice, which lessens the energy available for atomization, and it decreases shear intensity, which hinders the development of natural instabilities in the expanding liquid film. This delays atomization so that large droplets are formed The spray also characteristically forms a "tailing" or "fishtail" spray pattern. The surface tension and cohesive forces in the liquid film tend to gather more liquid at the edges of the spray fan than in the center, which produces coarsely atomized jets of coating. Sometimes the jets separate from the spray and deposit separate bands of coating. At other times, they thicken the edges so that more coating is deposited at the top and bottom than in the center of the spray. These deficiencies produce a non-uniform deposition pattern that makes it difficult to apply a uniform coating. The fishtail sprays are generally angular in shape and have a relatively narrow fan width, that is, a fan width that is not much greater than the fan width rating of the spray tip being used.

It is well known that liquid-film atomization can be improved if the liquid is made turbulent or agitated before it passes through the atomization orifice of the airless spray tip. Turbulent or agitated flow of the liquid as it exits the orifice promotes destabilization and disruption of the liquid film, which causes it to break up more readily into finer droplets and into a more uniform spray. For this reason, various types of turbulence promoters have been designed for use with conventional airless spray tips. Such turbulence promoters include various types of pre-orifices, diffusers, turbulence plates, restrictors, flow splitters/combiners, flow impingers, screens, baffles, vanes, and other inserts, devices, and flow networks known to those skilled in the art. Examples of such turbulence promoters and the turbulent flow created in the spray tip are illustrated in the catalog entitled "Airless Nozzles and Accessories", Nordson Corporation, Amherst, Ohio. One such example is a turbulence plate that is inserted into the inlet of the airless spray tip, wherein it divides the flow into two high velocity streams that impinge against one another head on at a ninety-degree angle to the main flow direction. The turbulent discharge then flows through the atomization orifice. Another such example is a restrictor plate that contains a pre-orifice that is somewhat larger in diameter than the atomization orifice. It is so positioned behind the atomization orifice to create a liquid jet that discharges against the atomization orifice, thereby generating the desired turbulence.

The ability to form fine droplets and a feathered spray are principle reasons why air sprays are used instead of airless sprays to apply high quality coatings. The air spray technique accomplishes this by using a large amount of compressed air. However, in contrast, it is well known that the airless spray technique, because it uses no compressed air, deposits the coating composition much more efficiently onto the substrate, that is, it has higher transfer efficiency. Therefore, while it is desirable to utilize airless spray techniques to obtain higher transfer efficiencies, its use is limited to applying low quality coatings because it characteristically does not provide a feathered spray or fine atomization.

Air-assisted airless spray combines features of air spray and airless spray, with intermediate results. It uses both compressed air and high pressure drop across the orifice to atomize the coating composition and to shape the liquid spray, typically under milder conditions than each type of atomization is generated by itself. The air assist helps to atomize the liquid film and to smooth out the spray to give a more uniform fan pattern. Generally, the compressed air pressure and the air flow rate are lower than for air spray. Liquid spray pressures typically range from 200 to 800 psi. However, like an air spray, air-assisted airless spray requires a relatively low viscosity, typically below 100 centipoise, and therefore uses a high concentration of organic solvents. The compressed air usage also typically produces lower transfer efficiency than with airless spray.

As disclosed in the aforementioned patent applications, it has been discovered that supercritical fluids or subcritical compressed fluids are not only effective viscosity reducers, but they can also remedy the defects of the airless spray process by creating vigorous decompressive atomization by a new airless spray atomization mechanism, which can produce the fine droplet size and feathered spray needed to apply high quality coatings.

In the spray application of coatings using supercritical fluids or subcritical compressed fluids such as carbon dioxide, the large concentration of carbon dioxide dissolved in the coating composition produces a liquid spray mixture that has markedly different properties from conventional coating compositions. In particular, the liquid spray mixture is highly compressible, that is, the density changes markedly with changes in pressure, whereas conventional coating compositions are incompressible liquids when they are sprayed.

Without wishing to be bound by theory, it is believed that vigorous decompressive atomization can be produced by the dissolved carbon dioxide suddenly becoming exceedingly supersaturated as the spray mixture leaves the nozzle and experiences a sudden and large drop in pressure. This creates a very large driving force for gasification of the carbon dioxide, which overwhelms the cohesion surface tension, and viscous forces that oppose atomization and normally bind the fluid flow together into a fishtail type of spray.

A different atomization mechanism is evident because atomization occurs right at the spray orifice instead of away from it as is conventional. Atomization is believed to be due not to the break-up of a liquid film from shear with the surrounding air, but instead, to the expansive forces of the compressible spray solution created by the carbon dioxide. Therefore, no liquid film is visible coming out of the nozzle.

Furthermore, because the spray is no longer bound by cohesion and surface tension forces, it leaves the nozzle at a much wider angle than normal airless sprays and produces a "feathered" spray with tapered edges like an air spray. This produces a rounded, parabolic-shaped spray fan instead of the sharp angular fans typical of conventional airless sprays. The spray also typically has a much wider fan width than conventional airless sprays produced by the same spray tip. As used herein, the terms "decompressive atomization" and "decompressive spray" each refer to a spray, spray fan, or spray pattern that has the preceding characteristics.

Laser light scattering measurements and comparative spray tests show that decompressive atomization can produce fine droplets that are in the same size range as air spray systems instead of the coarse droplets produced by normal airless sprays. These fine droplets are ideal for minimizing orange peel and other surface defects commonly associated with spray application. This fine particle size provides ample surface area for the dissolved carbon dioxide to very rapidly diffuse from the droplets within a short distance from the spray nozzle. The coating is therefore essentially free of carbon dioxide before it is deposited onto the substrate.

However, one problem we have noticed when spraying coating formulations with supercritical fluids or subcritical compressed fluids is the high average velocity of the spray. This produces a spray of fine droplets which may have excessively high momentum which causes a portion of the spray to be deflected sideways when the spray impacts upon a substrate. This may reduce transfer efficiency and make electrostatic attraction less effective. Consequently, this detracts from the previously described benefits derived from diluting coating formulations with supercritical fluids or subcritical compressed fluids and spraying the admixture onto a substrate. However, because the decompressive atomization mechanism does not depend upon spraying a coherent liquid out of the spray orifice at high velocity to create high shear with surrounding air, we have discovered that maintaining a sufficiently high velocity is no longer a critical design criterion for the spray tip.

The high velocity or thrust of the spray is believed to be due in part to using conventional airless spray tips that are designed for atomizing incompressible fluids by the liquid-film atomization mechanism, whereas the liquid spray mixture produced by using supercritical fluids or subcritical compressed fluids is highly compressible and produces atomization by an entirely different decompressive atomization mechanism. Thus, to improve liquid-film atomization, conventional airless spray tips are designed to maximize velocity and turbulence as the liquid flows through the atomization orifice for a given pressure drop across said orifice. In particular, in one important design standard, the flow path in the orifice is made very short in order to minimize flow resistance and reduction in turbulence. Furthermore, in addition to being used with turbulence promotion devices, conventional spray tips themselves are sometimes designed to promote turbulent or agitated flow of the liquid at the entrance to the atomization orifice. For example, the spray tip chamber that feeds liquid to the atomization orifice may be contoured or configured such that liquid flows from opposite sides of the chamber converge and impact each other as they flow into the atomization orifice.

The most commonly used airless spray tip design is sometimes called a dome-style spray tip. Such a spray tip is disclosed in, for example, U.S. Pat. No. 4,097,000, issued Jun. 27, 1978. The spray tip of this prior art embodiment is illustrated in FIGS. 1*a*, 1*b*, and 1*c* and is not a part of the present invention. FIG. 1*a* is a bottom plan view of body 10 and FIGS. 1*b* and 1*c* are vertical sectional views, which illustrate fluid flow patterns within feed passageway 15 and through orifice 20, with the aforementioned flow convergence and impaction clearly demonstrated. Body 10 is typically made from a tungsten carbide casting. It contains feed passageway 15 that is a hollow dome-shaped chamber centered about flow axis 30 of the spray tip. This hollow dome is formed in the spray orifice body before final hardening. The hollow dome extends nearly the length of the spray orifice body to such a depth that the roof or wall has the desired thickness at its convergent end. Orifice 20 is sometimes formed by cutting v-shaped groove 25 across the outside end of the dome such that the groove intersects and cuts into the hollow end of the dome. This creates orifice 20 with an elliptical, circular, or similarly shaped cross-section of very short length. The size (cross-sectional area) of orifice 20 is determined by the depth of v-shaped groove 25; that is, a larger orifice passageway produces a larger flow rate.

The angle of v-shaped groove 25 regulates the fan width of the spray, as is known to those skilled in the art. A smaller angle (narrower groove) produces a wider fan. A larger angle (wider groove) produces a narrower fan. The projected face of the discharge end of body 10 can be made in different geometries. A squared projected face is illustrated in FIGS. 1*b* and 1*c*. The projected face may also be rounded or domed. Other geometries can also be used, such as a projected face that is squared in the direction perpendicular to the groove but is rounded or domed in the direction parallel to the groove.

Still another dome-style spray tip is disclosed in, for example, U.S. Pat. No. 3,556,411, issued Jan. 19, 1971, which is illustrated in FIGS. 2*a* and 2*b* and which represent embodiments which are not in accordance with the present invention.

FIG. 2*a* shows a spray nozzle assembly that has an externally stepped and internally threaded stainless steel housing 40 that holds a tungsten carbide spray orifice body 50, which is secured in the housing by brazing at 51. The spray nozzle assembly has a turbulence plate 42 that discharges into spray orifice body 50 to promote turbulent flow through the spray orifice. Turbulence plate 42 is held in place by perforate screw 43. The spray nozzle assembly is attached to a spray gun (not shown) at face 41 by the use of a retaining nut (not shown). A gasket is sometimes inserted between face 41 and the spray gun to ensure that a pressure-tight seal is formed. FIG. 2*b* shows an example of a spray orifice body 50 that can be used in the spray nozzle assembly. It has a circular converging feed passageway 55 that is intersected by groove 65 to form orifice passageway 60.

Other types of dome-style spray tips, which have different mechanical features so as to produce a desired spray pattern, are disclosed in U.S. Pat. No. 3,647,147, issued Mar. 7, 1972; U.S. Pat. No. 3,659,787, issued May 2, 1972; U.S. Pat. No. 3,737,108, issued Jun. 5, 1973; U.S. Pat. No. 3,843,055, issued Oct. 22, 1974; and U.S. Pat. No. 3,754,710, issued Aug. 28, 1973.

A more recent airless spray tip design is called a Cross-Cut TM type spray tip, which is disclosed in U.S. Pat. No. 4,346,849, issued Aug. 31, 1982. As illustrated in FIG. 3, which is also not in accordance with the present invention, it is made by cutting interpenetrating grooves, at right angles to each other, into opposite sides of tungsten carbide spray orifice body 70. Groove 75 on the pressurized or inlet side is wedge-shaped in cross-section. Groove 85 on the unpressurized or exit side has a bottom portion that is trapezoidal in crosssection. Orifice 80 is formed by the interpenetration of groove 75 with groove 85. This gives a rectangular-shaped spray orifice passageway that has very short flow path length. The width of outer groove 85 regulates the fan width of the spray.

From the foregoing prior art, it is clear that the design of airless spray nozzles teaches, in part, that it is desirable to maintain a very short orifice path length to maximize turbulent flow from the spray orifice.

Other attempts have been made to obtain a desirable spray pattern from airless spray techniques. U.S. Pat. No. 3,054,563, issued Sep. 18, 1962, discloses a spray nozzle that has an insert to produce swirling motion at high circumferential velocity through the spray orifice, which opens onto a flat face on the top of a ridge and that is flared outwardly so as to form a gore-shaped opening. U.S. Pat. No. 3,858,812, issued Jan. 7, 1975, discloses a spray nozzle for low-pressure sprays, such as agricultural sprays at pressures of 30–60 psi, wherein large droplet size is desired to reduce drifting of sprayed chemicals. The spray nozzle has spaced projections at the entrance end of the nozzle passage leading to the orifice to promote uniformity of the spray. The patent teaches having an inlet chamber or bore that has a larger diameter than the nozzle passage leading to the orifice so that the decrease in diameter causes the liquid to flow to the orifice at a highly accelerated rate, so that the protuberances break up the flow direction through the nozzle passage and thereby produce a turbulent condition.

All of these prior art airless spray nozzle designs are directed to spraying conventional incompressible coating compositions. None of them uses supercritical fluids or subcritical compressed fluids as diluents to spray coating compositions or to spray compressible liquid mixtures.

The aforementioned Smith patents, which are directed to producing fine solid films and powders by using a "molecular" spray, disclose an apparatus which has an apparently elongated heated probe located within the sample collection chamber between the orifice and a transfer line coming from the heating oven. In particular, in the aforementioned Smith U.S. Pat. No. 4,734,227, it is taught that the process utilizes a fluid injection technique which calls for rapidly expanding the supercritical solution through a short orifice into the relatively lower pressure region. The text teaches away from using long orifice designs because, as noted, more conventional nozzles or longer orifice designs would enhance solvent cluster formation, which is taught as being undesirable. Consequently, the function of the apparently elongated probe is to convey, within the sample collection chamber, the fluid between the transfer line, located outside of said chamber, and the prescribed short orifice.

The related aforementioned Sievers, et al. patent similarly teaches the need for rapid expansion to prevent solvent cluster formation of the reagents and similarly utilizes very small orifice diameters of 5 to 50 microns or 1 to 10 microns to spray the dilute supercritical solutions.

Normal airless spray orifices for use with incompressible fluids are designed with the orifice path length as short as possible, so that turbulence induced in the fluid before it enters the nozzle orifice is suppressed as little as possible. It is well known that turbulence causes the coherent liquid film after it issues from said orifice to become unstable sooner and break up into finer drops.

However, as we have discovered, a spray of compressible fluid that contains a supercritical fluid or subcritical compressed fluid, such as carbon dioxide, can atomize at the orifice instead of away from it due to decompressive expansive forces, because the compressibility of the spray mixture causes the supersaturated spray liquid to expand in volume as it undergoes pressure reduction in the orifice. Furthermore, an expanding gas cloud is formed as carbon dioxide gas is released from the spray as it flows from the orifice. This gas cloud significantly reduces the shear that would normally occur with the surrounding air and that would normally significantly reduce the velocity of the spray.

Accordingly, we have discovered that maintaining turbulence and sufficiently high flow velocity are no longer critical design criteria—they are unnecessary due to the vigorous decompressive atomization that can occur when spraying coating compositions with supercritical fluids or subcritical compressed fluids. However, excessively high spray velocity or thrust persists due to the present use of conventional airless spray orifices with this new spray coating technology.

As noted above, the high spray velocity is due in part to the high spray pressure, generally in the range of 1,200 to 2,000 psi, that is used in spraying with supercritical fluids. But lowering spray pressure to resolve the high spray velocity effect is counterproductive, because less supercritical fluid can be dissolved in the coating formulation at lower pressure and the viscosity reduction benefits of the supercritical fluid are not as effectively utilized One potential solution to the poorer transfer efficiency and electrostatic attraction resulting from the high average spray velocity that we have found is to utilize a very small orifice size, for example a 5 mil orifice size instead of the commonly used 9 mil and larger orifice sizes. This does indeed reduce the spray velocity without being detrimental to good atomization. However, this solution is not constructive, because the smaller orifices suffer from much lower output, and orifice sizes below about 9 mil are also very susceptible to plugging, particularly with pigmented coating compositions.

Clearly, what is needed is an improved means for providing a feathered decompressive spray using an airless spray technique for spraying compressible liquid spray mixtures that contain supercritical fluids or subcritical compressed fluids, wherein the high average spray velocity normally associated with spraying said mixture, which may result in excessively high spray momentum and a portion of the spray being deflected sideways when impacting a substrate, is reduced. This would improve transfer efficiency in general and improve electrostatic attraction to the substrate when electrostatic spraying is used. It can clearly be seen that this problem cannot satisfactorily be solved using conventional airless spray equipment designed for incompressible fluids.

SUMMARY OF THE INVENTION

By virtue of the present invention, an apparatus has been discovered that has substantially eliminated the above-noted problems. Thus, by the apparatus of the present invention, means have now been provided which produce a feathered decompressive spray having a lower average spray velocity without affecting the desirable atomization characteristics while simultaneously attaining desirably improved transfer efficiency and enhanced electrostatic attraction.

Thus, in the broader embodiment of the present invention, the apparatus can be described as a spray orifice means having an orifice passageway comprising an elongated orifice passageway containing a small crosssectional area within said spray orifice means to reduce the average spray velocity of the feathered decompressive spray.

More particularly, in a more preferred embodiment, the apparatus of the present invention comprises a spray nozzle assembly for spraying a compressible coating mixture comprising coating composition and supercritical fluid or subcritical compressed fluid, said spray nozzle assembly having a spray tip body that has an orifice passageway from which said coating mixture is sprayed as a feathered decompressive spray, the improvement which comprises providing a sufficiently elongated orifice passageway with small cross-sectional area within said spray tip body to reduce the average spray velocity of said feathered decompressive spray.

In an alternative embodiment, the present invention is directed to a method for the airless spraying of a mixture of a non-compressible fluid and a compressible fluid which comprises passing the mixture under pressure through an orifice passageway to produce a spray having a first average spray velocity, the improvement which comprises providing an elongated orifice passageway which is elongated in at least an amount such that when spraying the mixture of non-compressible and compressible fluids through the elongated orifice passageway, a spray is produced having a second average spray velocity which is less than the first average spray velocity.

In still another embodiment, the present invention is directed to a method for reducing the average spray velocity of an airless spray stream comprised of a mixture of at least one non-compressible fluid and at least one compressible fluid which stream is formed by passing the mixture under pressure through an orifice passageway comprising passing the mixture through an orifice passageway having a passageway length L and an equivalent diameter D wherein the ratio L:D is in the range of from about 2:1 to about 20:1. Preferably, the ratio of L:D is in the range of from about 3:1 to about 15:1. More preferably, the ratio of L:D is in the range of from about 4:1 to about 10:1.

The average spray velocity is reduced by at least about 20%, preferably by at least about 25%, and most preferably by at least about 33%.

In one embodiment of the present invention, the spray tip body of the spray nozzle assembly contains a groove cut transversely across the outlet of the elongated orifice passageway so as to shape the feathered decompressive spray into a relatively flat spray fan. Preferably the groove is v-shaped or similarly shaped such that the angle of the groove regulates the width of the spray fan produced, as is known to those skilled in the art.

In another embodiment of the present invention, the spray tip body of the spray nozzle assembly may be described as having an elongated orifice passageway with small cross-sectional area along a longitudinal flow axis, a discharge end with a v-shaped groove formed transversely across the flow axis opening to shape the spray into a relatively flat fan, and an inlet end that opens onto a feed passageway that has a significantly larger crosssectional area than the orifice passageway.

The elongated orifice passageway of this invention comprises an elongated cavity that extends along the longitudinal flow axis. The elongated cavity preferably has an entirely concave or nearly concave cross-section so as to help prevent plugging of the particulates in the coating mixture. The orifice passageway may have a circular, oval or elliptical cross-section. An oval or elliptical cross-section is preferred for larger orifice equivalent diameters, because the ratio of circumference to cross-sectional area is more advantageous for reducing the spray velocity or thrust than a circular cross-section without increasing the risk of plugging. The long axis of the oval or elliptical cross-section is preferably oriented parallel to the groove that is formed transversely across the discharge end of the orifice passageway to shape the spray into a relatively flat fan, but other orientations, such as being perpendicular instead of parallel, may also be used.

The elongated orifice passageway cavity should desirably have an equivalent diameter that is substantially uniform over most of its length along the flow axis to effectively reduce the average spray velocity, although it may mildly be converging or diverging along its length, if so desired.

In yet another embodiment, the present invention is directed to a spray orifice body containing a first orifice passageway through which a material is passed under high pressure to form a spray, said first orifice passageway having an inlet end through which the material enters and an outlet end through which the material leaves as a spray, said first orifice passageway also having a length $L_1$ and an equivalent diameter $D_1$ wherein the ratio of $L_1$:$D_1$ is in the range of from about 2:1 to about 20:1.

The elongated orifice passageway cavity must be sufficiently long relative to the equivalent diameter to effectively reduce the average spray velocity, but it must not be so excessively long that the expansiveness of the spray mixture is severely depleted before the spray is discharged from the orifice. Preferably, the ratio of length to equivalent diameter is greater than about 2 and less than about 15. More preferably, the ratio of length to equivalent diameter is greater than about 3 and less than about 20. Most preferably, the ratio of length to equivalent diameter is greater than about 4 and less than about 10. So too, the length of the orifice passageway should desirably be in the range of from about 0.020 inch to about 0.400 inch, and more preferably be in the range of from about 0.040 inch to about 0.300 inch. This is in contrast to the conventional length of the prior art orifice passageways which typically is in the range of from about 0.002 inch to about 0.020 inch.

The orifice sizes suitable for the practice of the present invention generally range from about 0.004 inch to about 0.030 inch diameter. Because the orifices are generally not circular in cross-section, the diameters referred to are equivalent to a circular diameter The proper selection is determined by the orifice size that will supply the desired amount of liquid coating and accomplish proper atomization for the coating. Generally, smaller orifices are desired at lower viscosity and larger orifices are desired at higher viscosity. Larger orifices give higher output but poorer atomization. Finer atomization is preferred in the practice of the present invention. Accordingly, small orifice sizes of from about 0.007 inch to about 0.025 inch equivalent diameter are preferred. Orifice sizes of from about 0.009 inch to about 0.020 inch equivalent diameter are more preferred.

The feed passageway to the inlet of the elongated orifice passageway desirably has a significantly larger cross-sectional area than the orifice passageway, so that the flow resistance in the feed passageway is small compared to the flow resistance in the orifice passageway to prevent a significant loss of pressure before the compressible spray mixture enters the spray orifice passageway. However, the flow path from the flow control valve, which turns the spray on and off, to the spray orifice passageway desirably has minimal overall volume to promote clean valving of the compressible spray mixture.

By increasing the flow resistance in the spray orifice passageway during the decompressive expansion of the compressible spray mixture, the resulting velocity and thrust of the feathered decompressive spray is reduced without affecting the desirable atomization characteristics, which results in improved transfer efficiency and enhanced electrostatic attraction of the coating composition to the substrate.

Based on the above discussion of the prior art, the present invention contradicts that which is taught as being desirable to obtain good atomization. Yet, because of the nature of the material that is being sprayed, i.e., a mixture of a compressible and non-compressible fluid, the spray orifice means of the present invention nevertheless provides good atomization, reduced average flow velocity, and a desirable feathered spray to result in improved transfer efficiency.

BRIEF DESCRIPTION OF THE DRAWINGS

FIG. 4*a* is a rear plan view of a spray orifice body according to the present invention. FIG. 4*b* is a crosssectional view taken along line 4*b*—4*b* of FIG. 4*a*.

DETAILED DESCRIPTION OF THE INVENTION

Figure 1B:
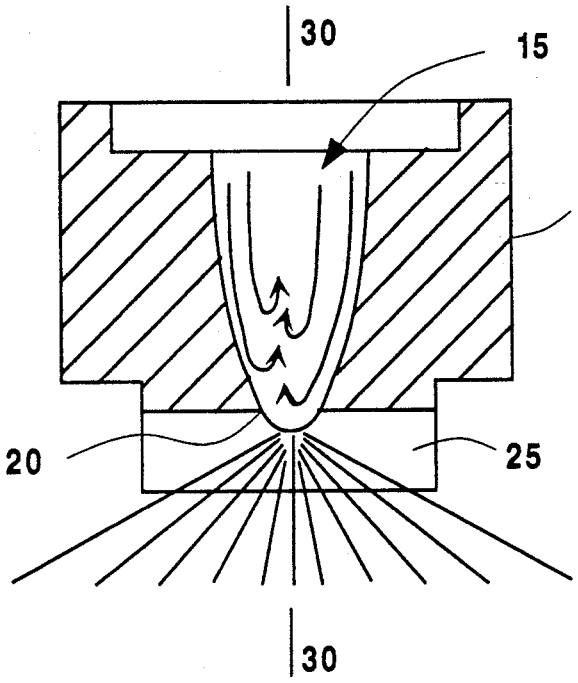
Fig. 1b (PRIOR ART)
FIGS. 1*b* and 1*c* are vertical elevational views taken along lines 1*b* and 1*c* of FIG. 1*a*, which illustrate fluid flow.
Figure 1A:
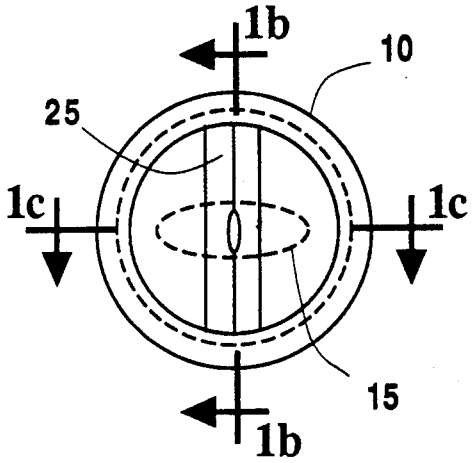
Fig. 1a (PRIOR ART)
FIG. 1*a* is an end view of a prior art conventional dome-style spray orifice body.
Figure 1C:
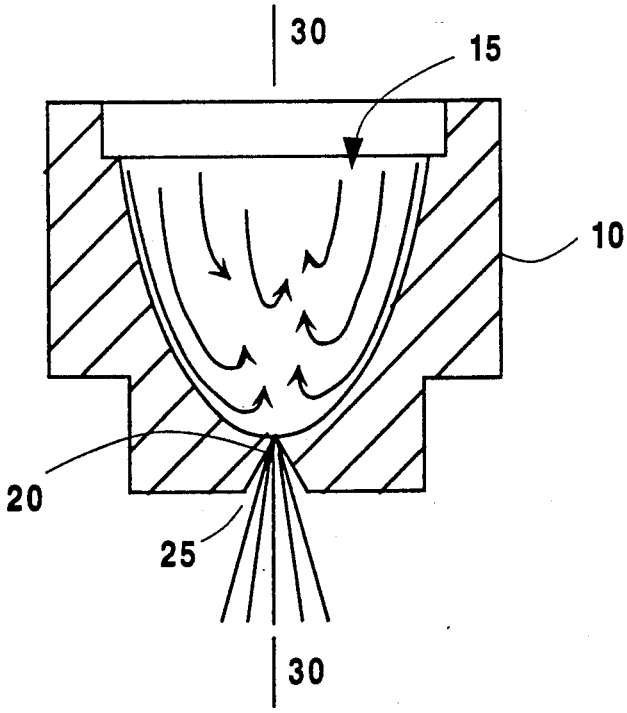
Fig. 1c (PRIOR ART)
Figure 2A:
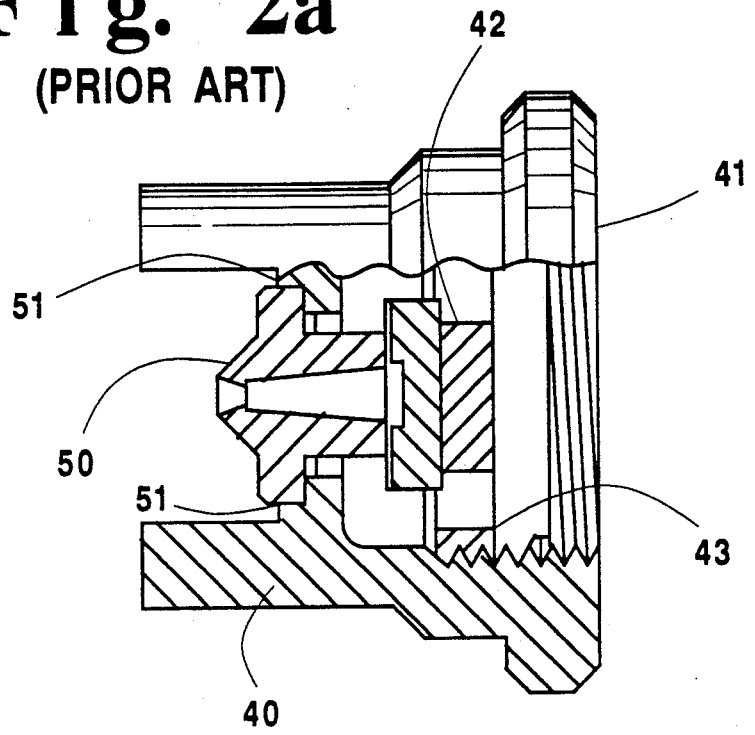
Fig. 2a (PRIOR ART)
FIG. 2*a* is a cross-sectional view of a prior art conventional spray nozzle assembly that has a dome-style spray orifice body and a turbulence plate.
Figure 2B:
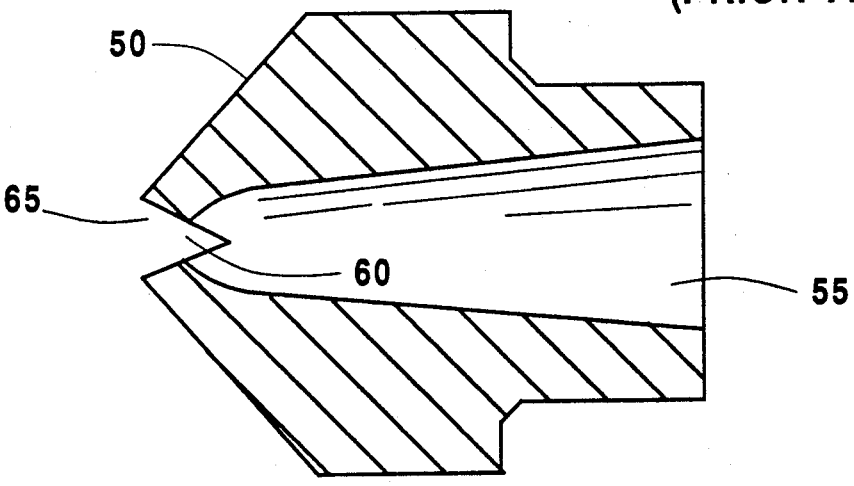
Fig. 2b (PRIOR ART)
FIG. 2*b* is an enlarged cross-sectional view of the prior art dome-style spray orifice body.
Figure 3:
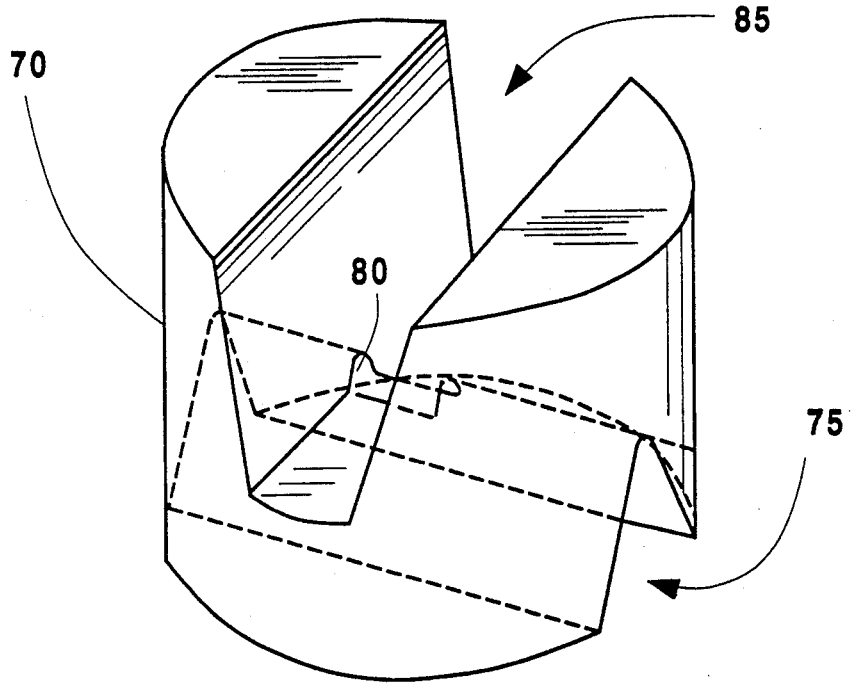
Fig. 3 (PRIOR ART)
FIG. 3 is a perspective view of a prior art conventional Cross-Cut TM type spray orifice body.

Because of its importance, a brief discussion of relevant supercritical fluid phenomena is warranted. Supercritical fluid phenomenon is well documented; see pages F-62 to F-64 of the CRC Handbook of Chemistry and Physics, 67th Edition, 1986–1987, published by CRC Press, Boca Raton, Fla. At high pressures above the critical point, the resulting supercritical fluid, or "dense gas", will attain densities approaching those of a liquid and will assume some of the properties of a liquid. These properties are dependent upon the fluid composition, temperature, and pressure. The compressibility of supercritical fluids is great just above the critical temperature where small changes in pressure result in large changes in the density of the supercritical fluid. The "liquid-like" behavior of a supercritical fluid at higher pressures can result in greatly enhanced viscosity reducing capabilities, with higher diffusion coefficients and an extended useful temperature range compared to liquids. Examples of such compounds which are well known to have utility as supercritical fluids are given in Table 1.

TABLE 1

EXAMPLES OF SUPERCRITICAL FLUIDS

| Compound | Boiling Point (C.) | Critical Temperature (C.) | Critical Pressure (atm) | Critical Density (g/ml) |
|---|---|---|---|---|
| Carbon Dioxide | −78.5 | 31.3 | 72.9 | 0.448 |
| Ammonia | −33.35 | 132.4 | 112.5 | 0.235 |
| Nitrous Oxide | −88.56 | 36.5 | 71.7 | 0.45 |
| Xenon | −108.2 | 16.6 | 57.6 | 0.118 |
| Krypton | −153.2 | −63.8 | 54.3 | 0.091 |
| Methane | −164.0 | −82.1 | 45.8 | 0.2 |
| Ethane | −88.63 | 32.28 | 48.1 | 0.203 |
| Ethylene | −103.7 | 9.21 | 49.7 | 0.218 |
| Propane | −42.1 | 96.67 | 41.9 | 0.217 |
| Pentane | 36.1 | 196.6 | 33.3 | 0.232 |
| Methanol | 64.7 | 240.5 | 78.9 | 0.272 |
| Ethanol | 78.5 | 243.0 | 63.0 | 0.276 |
| Isopropanol | 82.5 | 235.3 | 47.0 | 0.273 |
| Chlorotrifluoromethane | −31.2 | 28.0 | 38.7 | 0.579 |
| Monofluoromethane | −78.4 | 44.6 | 58.0 | 0.3 |

Near-supercritical liquids also demonstrate miscibility characteristics and other pertinent properties similar to those of supercritical fluids. The solute may be a liquid at the supercritical temperatures, even though it is a solid at lower temperatures. In addition, it has been demonstrated that fluid "modifiers" can often alter supercritical fluid properties significantly, even in relatively low concentrations, greatly increasing solubility for some solutes. These variations are considered to be within the concept of a supercritical fluid.

Due to the low cost, environmental acceptability, non-flammability and low critical temperature of carbon dioxide, supercritical carbon dioxide fluid is preferably used with the coating formulations. For many of the same reasons, nitrous oxide is a desirable supercritical fluid for admixture with the coating formulations. However, any of the aforementioned supercritical fluids and mixtures thereof are to be considered as being applicable for use with the coating formulations, with materials having lower critical pressures being more preferable than those having very high critical pressures, such as ammonia.

As discussed in the aforementioned related patent applications, the processes for spraying a coating composition containing a supercritical or subcritical compressed fluid are not narrowly critical to the type of coating formulations that can be sprayed provided that there is less than about 30% by weight of water in the diluent fraction of the formulation. Thus, essentially any coating formulation meeting the aforementioned water limit requirement which is conventionally sprayed with an airless spray technique may also be sprayed by means of the methods and apparatus discussed herein.

Such coating formulations are typically used for painting and finishing operations or for applying various adhesives compositions, mold release agents, and the like. Such coating formulations may also include those that are typically utilized in the agricultural field in which fertilizers, weed killing agents, and the like are dispensed.

Generally, such coating formulations typically include a solids fraction containing at least one component which is capable of forming a coating on a substrate, whether such component is an adhesive, a paint, lacquer, varnish, chemical agent, lubricant, protective oil, non-aqueous detergent, or the like. Typically, at least one component is a polymer component which is well known to those skilled in the coatings art.

The constituents used in the solids fraction, such as the polymers, must generally be able to withstand the temperatures and/or pressures which are involved when they are ultimately admixed with the at least one supercritical fluid. Such applicable polymers include thermoplastic or thermosetting materials or may be cross-linkable film forming systems.

In particular, the polymeric components include vinyl, acrylic, styrenic, and interpolymers of the base vinyl, acrylic, and styrenic monomers; polyesters, oil-free alkyds, alkyds, and the like; polyurethanes, oil-modified polyurethanes and thermoplastic urethanes systems; epoxy systems; phenolic systems; cellulosic esters such as acetate butyrate, acetate propionate, and nitrocellulose; amino resins such as urea formaldehyde, melamine formaldehyde, and other aminoplast polymers and resins materials; natural gums and resins; rubber-based adhesives including nitrile rubbers which are copolymers of unsaturated nitriles with dienes, styrene-butadiene rubbers, thermoplastic rubbers, neoprene or polychloroprene rubbers, and the like.

In addition to the polymeric compound that may be contained in the solids fraction, conventional additives which are typically utilized in coatings may also be used. For example, pigments, pigment extenders, metallic flakes, fillers, drying agents, anti-foaming agents, and anti-skinning agents, wetting agents, ultraviolet absorbers, cross-linking agents, and mixtures thereof, may all be utilized in the coating formulation to be sprayed.

In addition to the solids fraction, a solvent fraction is also typically employed in the coating formulations whether they be an adhesive composition or a paint, lacquer, varnish, or the like, or an agricultural spray, in order to act as a vehicle in which the solid fraction is transported from one medium to another. As used herein, the solvent fraction is comprised of essentially any active organic solvent and/or non-aqueous diluent which is at least partially miscible with the solids fraction so as to form either a solution, dispersion, or suspension. As used herein, an "active solvent" is a solvent in which the solids fraction is at least partially soluble. The selection of a particular solvent fraction for a given solids fraction in order to form a specific coating formulation for application by airless spray techniques is conventional and well known to those skilled in the art. In general, up to about 30% by weight of water, preferably up to about 20% by weight, may also be present in the solvent fraction provided that a coupling solvent is also present in the formulation. All such solvent fractions are suitable.

A coupling-solvent is a solvent in which the polymeric compounds used in the solids fraction is at least partially soluble. Most importantly, however, such a coupling solvent is also at least partially miscible with water. Thus, the coupling solvent enables the miscibility of the solids fraction, the solvent fraction and the water to the extent that a single phase is desirably maintained such that the composition may optimally be sprayed and a good coating formed.

Coupling solvents are well known to those skilled in the art and any conventional coupling solvents which are able to meet the aforementioned characteristics, namely, those in which the polymeric components of the solid fraction is at least partially soluble and in which water is at least partially miscible are all suitable for being used.

Applicable coupling solvents which may be used include, but are not limited to, ethylene glycol ethers; propylene glycol ethers; chemical and physical combinations thereof; lactams; cyclic ureas; and the like.

Specific coupling solvents (which are listed in order of most effectiveness to least effectiveness) include butoxy ethanol, propoxy ethanol, hexoxy ethanol, isopropoxy 2-propanol, butoxy 2-propanol, propoxy 2-propanol, tertiary butoxy 2-propanol, ethoxy ethanol, butoxy ethoxy ethanol, propoxy ethoxy ethanol, hexoxy ethoxy ethanol, methoxy ethanol, methoxy 2-propanol, and ethoxy ethanol. Also included are lactams such as n-methyl-2-pyrrolidone, and cyclic ureas such as dimethyl ethylene urea.

When water is not present in the coating formulation, a coupling solvent is not necessary, but may still be employed. Other solvents, particularly active solvents, which may be present in typical coating formulations and which may be utilized include ketones such as acetone, methyl ethyl ketone, methyl isobutyl ketone, mesityl oxide, methyl amyl ketone, cyclohexanone and other aliphatic ketones; esters such as methyl acetate, ethyl acetate, alkyl carboxylic esters; ethers, such as methyl t-butyl ether, dibutyl ether, methyl phenyl ether and other aliphatic or alkyl aromatic ethers; glycol ethers such as ethoxy ethanol, butoxy ethanol, ethoxy 2-propanol, propoxy ethanol, butoxy 2-propanol and other glycol ethers; glycol ether esters such as butoxy ethoxy acetate, ethyl 3-ethoxy propionate and other glycol ether esters; alcohols such as methanol, ethanol, propanol, iso-propanol, butanol, iso-butanol, amyl alcohol and other aliphatic alcohols; aromatic hydrocarbons such as toluene, xylene, and other aromatics or mixtures of aromatic solvents; aliphatic hydrocarbons such as VM&P naphtha and mineral spirits, and other aliphatics or mixtures of aliphatics; nitro alkanes such as 2-nitropropane. A review of the structural relationships important to the choice of solvent or solvent blend is given by Dandge, et al., *Ind. Eng, Chem.* (Product Research and Development) 24, 162, 1985 and Francis, A. W., *J. Phys. Chem.* 58, 1099, 1954.

Of course, there are solvents which can function both as coupling solvents as well as active solvents and the one solvent may be used to accomplish both purposes. Such solvents include, for example, butoxy ethanol, propoxy ethanol and propoxy 2-propanol. Glycol ethers are particularly preferred.

Suitable additives that are conventionally present in coating formulations that are intended for spray application may also be present: such as, curing agents, plasticizers, surfactants, and the like.

The liquid mixture of polymers (a), a solvent component containing at least one supercritical fluid (b), and optionally, an active solvent (c), is sprayed onto a substrate to form a liquid coating thereon by passing the liquid mixture under pressure through an orifice into the environment of the substrate to form a liquid spray.

An orifice is a hole or an opening in a wall or housing, such as in a spray tip of a spray nozzle on a spray gun, through which the liquid mixture of (a), (b), and optionally (c) flows in going from a region of higher pressure, such as inside the spray gun, into a region of lower pressure, such as the air environment outside of the spray gun and around the substrate.

The environment into which the coating mixture is sprayed is not critical. However, the pressure therein must be less than that required to maintain the supercritical fluid component of the liquid spray mixture in the supercritical state. Preferably, the coating mixture is sprayed in air under conditions at or near atmospheric pressure. Other gas environments can also be used, such as air with reduced oxygen content or inert gases such as nitrogen, carbon dioxide, helium, argon, xenon, or a mixture thereof. Oxygen or oxygen enriched air is not desirable, because oxygen enhances the flammability of organic components in the spray.

Generally, liquid spray droplets are produced which generally have an average diameter of one micron or greater. These liquid droplets contain a portion of the solids, a portion of the solvent, and a portion of the supercritical fluid. Preferably, these droplets have average diameters of from about 5 to 1,000 microns. Small spray droplets are desirable to vent the supercritical fluid from the spray droplet before impacting the substrate. Small spray droplets also give higher quality finishes.

The apparatus and methods of the present invention may be used to apply coatings by the application of liquid spray to a variety of substrates. Examples of suitable substrates include, but are not limited to, metals, wood, glass, plastic, paper, cloth, ceramic, masonry, stone, cement, asphalt, rubber, and composite materials, and agriculturally related substrate.

Through the practice of the present invention, films may be applied to a substrate such that the cured films have thicknesses of from about 0.2 to about 4.0 mils. Preferably, the films have thicknesses of from about 0.5 to about 2.0 mils, while most preferable, their thicknesses range from about 0.7 to about 1.5 mils.

If curing of the coating composition present upon the coated substrate is required, it may be performed by conventional means, such as allowing for evaporation of the active and/or coupling solvent, application of heat or ultraviolet light, etc.

Furthermore, it has been found that compressible supercritical fluid sprays do not require turbulence promoters to achieve good atomization. In fact, instead of improving said spray, turbulence promoters can do the opposite and make it worse. Turbulence promoters cause the fluid pressure to drop before the fluid reaches the atomization orifice, which causes the supercritical fluid component to come out of solution prematurely. Thus, maintaining turbulent flow through the spray orifice, often by maintaining a short orifice path length which suppresses turbulence as little as possible, is no longer a desirable design criteria for the spray tip.

The difference between spraying a viscous fluid mixture containing a compressible supercritical fluid component and spraying conventional, non-compressible liquids can be seen by comparing the sprays and atomization achieved with dome-style and Cross-Cut TM style airless spray tips. In the Cross-Cut TM style tip, the edges of the orifice are sharper and more regular, so flow frictional resistance is reduced. There is generally less physical separation between material at the inlet and outlet of the orifice; that is, the flow path length is generally shorter than in dome-style orifices. The Cross-Cut TM spray tip design usually improved atomization over the dome-style spray tip when spraying normal, non-compressible liquids. It is capable of better atomization at lower pressures and is less easily plugged Contrary to what is expected by one of ordinary skill in the art, we have found that the reverse is true when spraying compressible spray mixtures with supercritical fluids—the Cross-Cut TM spray tip design gives markedly poorer atomization than the dome-style tip. Generally the droplets in the spray are much coarser and much poorer coatings result. This implies that increasing the orifice flow path length, which is inherently relatively long in the dome-style tip design, to provide greater flow frictional resistance and therefore lower spray velocity would not adversely affect atomization.

Furthermore, we have found that passing the spray mixture containing a supercritical fluid component through a long small-diameter hole in a plastic insert in the spray nozzle assembly does not adversely affect atomization and gives a somewhat slower, softer spray.

In previous experimental endeavors, we have found, for example, in order to have clean valving of the spray gun, that is, to provide no spitting or foaming, there must be minimal void space between the spray valve and the atomization orifice. Otherwise, when the valve is closed, any material left in the spray tip depressurizes and the gas that forms drives the remaining coating formulation out of the orifice as coarsely atomized droplets or as foam that blocks the orifice. To decrease the void volume, a plastic insert can be placed inside the tip. Such an insert, for use with normal (non-compressible fluid mixtures) is commercially available from, for example, Spraying Systems Co. as insert #15153-NY. The insert normally has a bore through the center that is 62 mils in diameter and .188 mils long. In order to further reduce the void volume, we prepared a special insert that had a bore which is 31 mils in diameter and the same length. Therefore, it had 75 percent less cross-sectional area. When this special narrow-bore insert was used, it produced a somewhat lower velocity, which resulted in a softer spray that did not adversely affect atomization or the spray pattern.

This, therefore, demonstrated that increasing the flow path length of the atomization orifice itself, such as in dome-style type airless spray tips, would significantly reduce spray velocity and thrust without causing premature pressure drop when spraying compressible spray mixtures of coating formulation and the like containing supercritical fluids such as carbon dioxide or nitrous oxide.

A spray orifice body 100 that embodies the concepts of the present invention is illustrated in FIGS. 4*a* and 4*b*. FIG. 4*a* shows a rear plan view and FIG. 4*b* shows a cross-sectional view along line 4*b*—4*b* in FIG. 4*a*. It has a feed passageway 110 that feeds into a circular elongated orifice passageway 120. A v-shaped groove 130 is cut through the discharge end of the orifice passageway to shape the spray into a relatively flat fan. Orifice passageway 120 has a ratio of length to equivalent diameter of about 5. The elongated orifice passageway provides a quieting portion that reduces the spray velocity and thrust without causing premature pressure drop in the compressible spray mixture. The spray mixture discharges from orifice passageway 120 as a feathered decompressive spray.

Figure 5A:
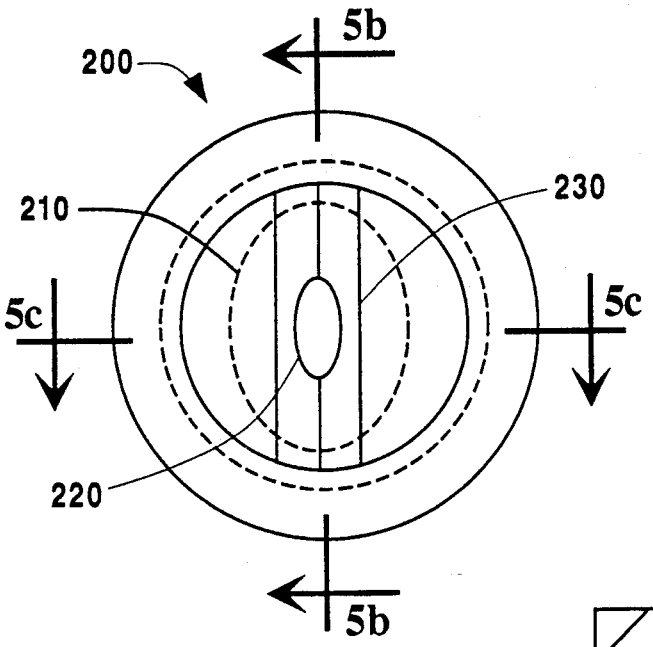
FIG. 5*a* is a front plan view of another spray orifice body according to the present invention.
Figure 5B:
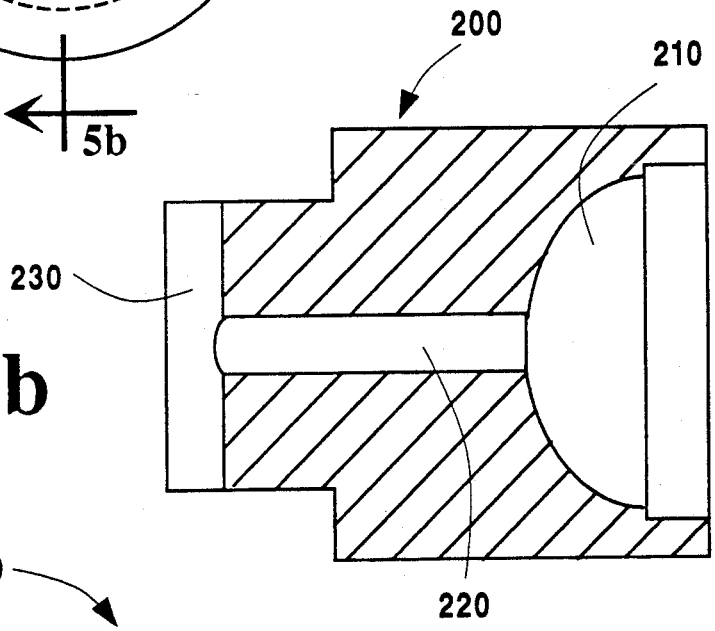
FIGS. 5*b* and 5*c* are crosssectional views along lines 5*b*—5*b* and 5*c*–5*c*, respectively, of FIG. 5*a*.
Figure 5C:
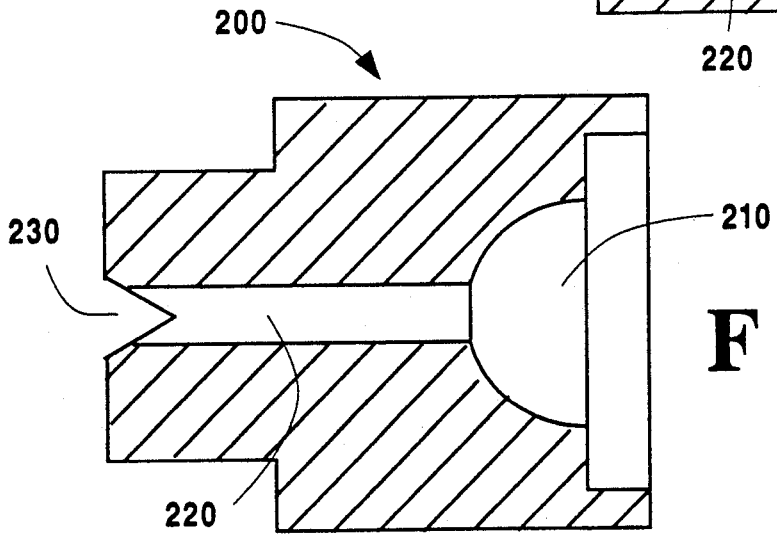

Another spray orifice body that embodies the concepts of the present invention is illustrated in FIGS. 5*a*, 5*b*, and 5*c*. FIG. 5*a* shows a front plan view and FIGS. 5*b* and 5*c* show cross-sectional views along lines 5*b*—5*b* and 5*c*—5*c*, respectively, in FIG. 5*a*. A feed passageway 210 feeds into an elliptical elongated orifice passageway 220. A v-shaped groove 230 is cut through the discharge end of the orifice passageway to shape the spray into a relatively flat fan. Orifice passageway 220 has a ratio of length to equivalent diameter of about 5. The elongated orifice passageway provides a quieting portion that reduces the spray velocity and thrust without causing premature pressure drop in the compressible spray mixture. The spray mixture discharges from orifice passageway 210 as a feathered decompressive spray. This design is advantageous for larger spray orifice equivalent diameters, with the small axis of the elliptical cross-section having a dimension of about 9 mils. This is preferable instead of using a circular orifice passage way with a larger diameter, because the elliptical shape has more wall surface area to more effectively create flow resistance, thereby more effectively reducing flow velocity and thrust.

It will be readily apparent that the specific curvature or convergence of the sidewalls and edge portions of the feed passageway and the elongated orifice passageway may be modified or altered from that shown to other geometric designs or configurations to produce different specific discharge patterns or to effect different volumetric fluid flow, velocity and thrust. Likewise, the effective diameters of the feed passageway and orifice passageway and their ratio with respect to each other may be changed without altering the spirit and scope of the invention.

Furthermore, for very large orifice size, another embodiment is the utilization of two smaller orifice channels that run side by side and enter the v-shaped notch that shapes the spray either side by side or joined together at the v-notch channel. If the two orifice passageways are placed at an angle such that the discharges from each impact each other, then some of the momentum of each spray is dissipated by the impact so that forward spray velocity is reduced further.

Preferably, air-assist should desirably not be utilized with the elongated spray orifice means of the present invention inasmuch as it would tend to increase the average spray velocity and air volume thereby counteracting the benefit of this elongated design.

So too, it is preferable that the spray that is formed by means of the elongated spray means of the present invention be introduced into an environment which is not subatmospheric in pressure. Instead, it would be advantageous to introduce the spray in a zone of superatomospheric pressure which would act to further reduce the average spray velocity. For the same reason, the spray should desirably not be introduced into a zone of very hot temperature due to the lower density present which would have less of an effect on reducing the average spray velocity.

Still further, short spray distances between the orifice and the substrate to be coated are also not desirable. This is due to the average spray velocity being higher when it is closer to the outlet end of the orifice, i.e, the average spray velocity has not been reduced as much by the atmosphere into which the material is sprayed. Preferred spray distances are in the range of from about 6 to about 20 inches, more preferably in the range of from about 10 to about 16 inches.

Conventional and electrostatic airless spray nozzle assemblies and spray guns may be assembled with the spray orifice body of the present invention as is known to those skilled in the art provided they meet the specified requirements of clean valving and non-interference with the wide spray angle produced by the feathered decompressive spray. The spray guns, spray nozzle assemblies, and spray orifice bodies must be built to contain the spray pressure used. The material of construction of the spray orifice body must possess the necessary mechanical strength for the high spray pressure, have sufficient abrasion resistance to resist wear from fluid flow, and be inert to chemicals with which it comes into contact. Any of the materials used in the construction of airless spray tips, such as boron carbide, titanium carbide, ceramic, stainless steel or brass, is suitable, with tungsten carbide generally being preferred.

Electrostatic forces may optionally be used to increase the proportion of coating material that is deposited onto a substrate from the spray, which is commonly referred to as increasing the transfer efficiency. This is done by using a high electrical voltage relative to the substrate to impart an electrical charge to the spray. This creates an electrical force of attraction between the spray droplets and the substrate which causes droplets that would otherwise miss the substrate to be deposited onto it. When the electrical force causes droplets to be deposited on the edges and backside of the substrate, this effect is commonly referred to as wrap around. As aforementioned, with the velocity and thrust experienced when spraying viscous coating formulation containing compressible supercritical fluids as diluents while using conventional spray nozzles designed for use with non-compressible fluids, undesirable lower transfer efficiency and electrostatic attraction is observed, even when utilizing the said electrostatic spraying techniques.

Preferably the substrate is grounded, but it may also be charged to the opposite sign as the spray. The substrate may be charged to the same sign as the spray, but at a lower voltage with respect to ground, but this is of less benefit, because this produces a weaker electrical force of attraction between the spray and the substrate than if the substrate were electrically grounded or charged to the opposite sign. Electrically grounding the substrate is the safest mode of operation. Preferably the spray is charged negative relative to electrical ground.

The method of charging the spray is not critical provided the charging method is effective. The coating material can be electrically charged by applying high electrical voltage relative to the substrate and electrical current: 1) within the spray gun, by direct contact with electrified walls or internal electrodes before leaving the orifice; 2) after the spray emerges from the orifice by electrical discharge from external electrodes located near the orifice and close to the spray; or 3) away from the orifice, by passing the spray through or between electrified grids or arrays of external electrodes before the spray is deposited onto the substrate.

The apparatus can be used with high electrical voltage in the range of about 30 to about 150 kilovolts. Higher electrical voltages are favored to impart higher electrical charge to the spray to enhance attraction to the substrate, but the voltage level must be safe for the type of charging and spray gun used. For safety reasons, the voltage of hand spray guns is usually restricted to less than 70 kilovolts and the equipment is designed to automatically shut off the voltage when the current exceeds a safe level. Generally, for hand spray guns the useful range of electrical current is between 20 and 200 microamperes and optimum results are obtained with coating materials that have very low electrical conductivity, that is, very high electrical resistance. For automatic spray guns that are used remotely, higher voltages and electrical currents can be safely used than for hand spray guns. Therefore, the voltage can exceed 70 kilovolts up to 150 kilovolts and the current can exceed 200 microamperes.

These methods of electrostatic charging are known to those who are skilled in the art of electrostatic spraying.

For electrostatic spraying, the substrate is preferably an electrical conductor, such as metal, but substrates that are not conductors or semiconductors may also be sprayed. Preferable, they are pretreated to create an electrically conducting surface. For instance, the substrate may be immersed in a special solution to impart conductivity to the surface.

The method of generating the high electrical voltage and electrical current is not critical. Conventional high voltage electrical power supplies can be used. The power supply should have standard safety features that prevent current or voltage surges. The electrical power supply may be built into the spray guns. Other charging methods may also be used.

While preferred forms of the present invention have been described, it should be apparent to those skilled in the art that methods and apparatus may be employed that are different from those shown without departing from the spirit and scope thereof.

What is claimed is:

1. In a method for the airless spraying of a mixture of a non-compressible fluid and a compressible fluid which compressible fluid is a gas at standard conditions of 0° C. and one atmosphere (STP) which comprises passing the mixture under pressure through a first orifice passageway to produce a decompressive spray having a first average spray velocity, the improvement which comprises providing an elongated first orifice passageway which is elongated in at least an amount such that when spraying the mixture of non-compressible and compressible fluids through the elongated first orifice passageway, a decompressive spray is produced having a second average spray velocity which is less than the first average spray velocity.

2. The method of claim 1, wherein the first orifice passageway has a length which is in the range of from about 0.002 inch to about 0.020 inch and the elongated first orifice passageway has a length which is in the range of from about 0.020 inch to about 0.400 inch.

3. The method of claim 2, wherein the length of the elongated first orifice passageway is in the range of from about 0.040 inch to about 0.300 inch.

4. The method of claim 2, wherein the elongated first orifice passageway has an equivalent diameter in the range of from about 0.007 inch to about 0.025 inch.

5. The method of claim 2, wherein the elongated first orifice passageway has an equivalent diameter in the range of from about 0.009 inch to about 0.020 inch.

6. The method of claim 1, wherein the non-compressible fluid is a coating material.

7. The method of claim 1, wherein the compressible fluid is a supercritical compressed fluid.

8. The method of claim 7, wherein the compressible fluid is carbon dioxide.

9. The method of claim 1, wherein the ratio of the elongated first orifice passageway length to its equivalent diameter is in the range of from about 2 to about 20.

10. The method of claim 9, wherein the ratio of the elongated first orifice passageway length to its equivalent diameter is in the range of from about 3 to about 15.

11. The method of claim 10, wherein the ratio of the elongated first orifice passageway length to its equivalent diameter is in the range of from about 4 to about 10.

12. The method of claim 1, wherein the first average spray velocity is reduced by at least about 20%.

13. The method of claim 12, wherein the first average spray velocity is reduced by at least about 25%.

14. The method of claim 13, wherein the first average spray velocity is reduced by at least about 33%.

15. The method of claim 1, wherein the compressible fluid is a subcritical compressed fluid.

16. The method of claim 15, wherein the compressible fluid is carbon dioxide.

17. A method for reducing the average spray velocity of a decompressive airless spray stream comprised of a mixture of at least one non-compressible fluid and at least one compressible fluid which compressible fluid is a gas at standard conditions of 0° C. and one atmosphere (STP) which stream is formed by passing the mixture under pressure through an orifice passageway comprising passing the mixture through an orifice passageway having a passageway length L and an equivalent diameter D wherein the ratio L:D is in the range of from about 2:1 to about 20:1.

18. The method of claim 17, wherein the ratio L:D is in the range of from about 3:1 to about 15:1.

19. The method of claim 18, wherein the ratio L:D is in the range of from about 4:1 to about 10:1.

20. The method of claim 17, wherein the average spray velocity of the airless spray stream is reduced by at least about 20%.

21. The method of claim 20, wherein the average spray velocity of the airless spray stream is reduced by at least about 25%.

22. The method of claim 21, wherein the average spray velocity of the airless spray stream is reduced by at least about 33%.

23. The method of claim 17, wherein the length of the orifice passageway is in the range of from about 0.020 inch to about 0.400 inch.

24. The method of claim 23, wherein the length of the orifice passageway is in the range of from about 0.040 inch to about 0.300 inch.

25. The method of claim 17, wherein the equivalent diameter of the orifice passageway is in the range of from about 0.007 inch to about 0.025 inch.

26. The method of claim 25 wherein the equivalent diameter of the orifice passageway is in the range of from about 0.009 inch to about 0.020 inch.

27. The method of claim 17, wherein the non-compressible fluid is a coating material.

28. The method of claim 17, wherein the compressed fluid is a supercritical compressed fluid.

29. The method of claim 28, wherein the compressible fluid is carbon dioxide.

30. The method of claim 17, wherein the compressible fluid is a subcritical compressed fluid.

31. The method of claim 30, wherein the compressible fluid is carbon dioxide.

32. In a method for the airless spraying of a mixture of a non-compressible fluid and a supercritical fluid which comprises passing the mixture under pressure through a first orifice passageway to produce a decompressive spray having a first average spray velocity, the improvement which comprises providing an elongated first orifice passageway which is elongated in at least an amount such that when spraying the mixture of non-compressible and supercritical fluids through the elongated first orifice passageway, a decompressive spray is produced having a second average spray velocity which is less than the first average spray velocity.

33. A method for reducing the average spray velocity of a decompressive airless spray stream comprised of a mixture of at least one non-compressible fluid and at least one supercritical fluid which stream is formed by passing the mixture under pressure through an orifice passageway comprising passing the mixture through an orifice passageway having a passageway length L and an equivalent diameter D wherein the ratio L:D is in the range of from about 2:1 to about 20:1.

* * * * *